US006751913B2

(12) United States Patent
Marrotte et al.

(10) Patent No.: US 6,751,913 B2
(45) Date of Patent: Jun. 22, 2004

(54) VERTICAL WALL STRUCTURE WITH ELECTRICAL SERVICE

(75) Inventors: John R. Marrotte, Windham, CT (US); Richard R. Picard, Jr., West Hartford, CT (US)

(73) Assignee: The Wiremold Company, West Hartford, CT (US)

( * ) Notice: Subject to any disclaimer, the term of this patent is extended or adjusted under 35 U.S.C. 154(b) by 53 days.

(21) Appl. No.: 09/861,239

(22) Filed: May 18, 2001

(65) Prior Publication Data

US 2002/0170239 A1 Nov. 21, 2002

(51) Int. Cl.[7] ..... H02G 3/04; E04C 2/52

(52) U.S. Cl. ..... 52/220.7; 52/36.1; 52/481.1; 52/481.2; 52/482; 52/220.5; 52/220.1; 52/239; 52/238.1; 52/281; 52/241; 52/242; 52/653.1; 174/49; 248/918; 220/3.2

(58) Field of Search ..... 52/36.1, 481.2, 52/220.7, 239, 220.5, 482, 481.1, 220.1, 281, 653.1, 654.1, 241, 242; 174/49; 248/918

(56) References Cited

U.S. PATENT DOCUMENTS

| | | | | | |
|---|---|---|---|---|---|
| 3,449,877 | A | * | 6/1969 | Beckman | 52/127.12 |
| 3,609,211 | A | * | 9/1971 | Van Herk | 174/49 |
| 3,781,567 | A | * | 12/1973 | Papsco | 174/48 |
| 3,814,833 | A | * | 6/1974 | Yamada et al. | 174/48 |
| 3,918,223 | A | * | 11/1975 | Carlsson | 174/48 |
| 4,015,397 | A | * | 4/1977 | Flachbarth et al. | 174/48 |
| 4,224,769 | A | * | 9/1980 | Ball et al. | 312/140.1 |
| 4,252,989 | A | * | 2/1981 | Blumenthal | 174/48 |
| 4,475,322 | A | * | 10/1984 | Russo et al. | 312/209 |
| 5,116,235 | A | * | 5/1992 | Nienhuis et al. | 439/211 |
| 5,150,554 | A | * | 9/1992 | Quinlan et al. | 160/351 |
| 5,195,286 | A | * | 3/1993 | DeLong et al. | 174/48 |
| 5,284,255 | A | * | 2/1994 | Foster et al. | 174/48 |
| 5,287,666 | A | * | 2/1994 | Frascaroli et al. | 52/239 |
| 5,618,090 | A | * | 4/1997 | Montague et al. | 211/26 |
| 5,768,840 | A | * | 6/1998 | Feldpausch et al. | 52/220.5 |
| 5,896,710 | A | * | 4/1999 | Hoyle | 160/135 |
| 6,170,200 | B1 | * | 1/2001 | Cornell et al. | 160/196.1 |
| 6,374,548 | B1 | * | 4/2002 | Ruedinger et al. | 52/36.1 |

FOREIGN PATENT DOCUMENTS

| | | | |
|---|---|---|---|
| EP | 0232212 | | 8/1987 |
| EP | 0360772 | | 3/1990 |
| EP | 0547473 | | 6/1993 |
| FR | 2290064 | | 5/1976 |
| FR | 0232212 | * | 8/1987 |

* cited by examiner

*Primary Examiner*—Carl D. Friedman
*Assistant Examiner*—Christy M. Green
(74) *Attorney, Agent, or Firm*—McCormick, Paulding & Huber LLP

(57) ABSTRACT

A wall structure includes at least two studs that are designed to support panels front and back, and end caps or raceway channel defining members on the leading and trailing edges of the panel wall structure. Each of the studs includes sets of oppositely arranged flanges that in turn cooperate with marginal edges of both the panels and the raceway defining members. Cross bracing is provided to allow wiring either within the enclosed space between the panels, or more preferably in the wireways defined in the raceway members so that the power and data communication conductors can be isolated from one another. The feature of the panel structure is that the panels themselves can support light fixtures or other lightweight electrical devices, and heavier electrical devices or units can be accommodated from the cross bracing or from shelves secured to the cross bracing and to the studs. Knockout openings in the studs and in the cross bracing provides for convenience in wiring and in mounting of electrical devices generally.

7 Claims, 4 Drawing Sheets

VERTICAL WALL STRUCTURE WITH ELECTRICAL SERVICE

This invention relates generally to a wall structure or column for housing electrical services such as power and data communication wiring, and deals more particularly with such a wall structure as can also be made suitable for supporting electrical apparatus and/or lighting fixtures or the like.

The prior art is replete with power poles or columns for distributing electrical services to a work area or office space, and the prior art also includes power distribution systems for office corals and similar enclosures such as are filled with desktops or other work station environments.

The aim of the present invention is to provide an architecturally striking vertical wall structure that can serve as a divider wall or power pole, or as a self sustained support for control panels and light fixtures and video equipment of various types.

SUMMARY OF THE INVENTION

In accordance with the present invention, a vertically oriented wall structure is provided with a pair of elongated studs having a cross-sectional shape that includes at least two sets of oppositely projecting flanges integrally connected to a web so as to define a generally I-shape such that the opposed sets of flanges can support panels that are provided with marginal edges defining inturned lips that mate with the flanges of one set so that the panels are entirely supported between the studs and define the front and rear surfaces of the wall structure.

Wireways are defined in elongated raceway members that cooperate with the web portions of these studs, and with a second set of flanges on the studs to provide a convenient area for housing the power and the data wiring normally required in today s office spaces.

Cross braces are provided between the studs to secure the vertically spaced studs to one another, and to serve as convenient supports for various electrical and electronic equipment that might be housed within the enclosure defined by the front and rear panels. Alternatively equipment can also be mounted on the panels or directly to these studs and cross braces.

In the preferred embodiment the raceway members have a cross-sectional shape that is generally of convex external contour, and that mates with the generally flat panels so that a pleasing appearance is provided, with the external surfaces of both the elongated raceway members and the panels arranged tangential to one another. The panels may also be slightly curved to achieve an architecturally pleasing appearance.

The surface of panels may be textured or other architectural treatment. For example, the panels can have openings in the event that the wall structure is internally lighted, or is otherwise made to appear less intrusive in the environment where it is placed.

The raceway members that cooperate with the studs define a generally D-shaped wireway for the power and data wiring, and the studs are provided with knockout openings to receive electrical devices of various types (such as duplex plug outlets, telecommunications jack, connections, and other conventional components such as switches and the like). Further, the cross braces are also provided with knockout openings to provide wiring in the enclosed space between the front and rear panels of the wall structure. Lighting fixtures and other lightly supported electrical components can be directly mounted on the wall panels, whereas heavier equipment such as video equipment is supported directly from the studs and/or the cross braces.

DETAILED DESCRIPTION

Figure 1:
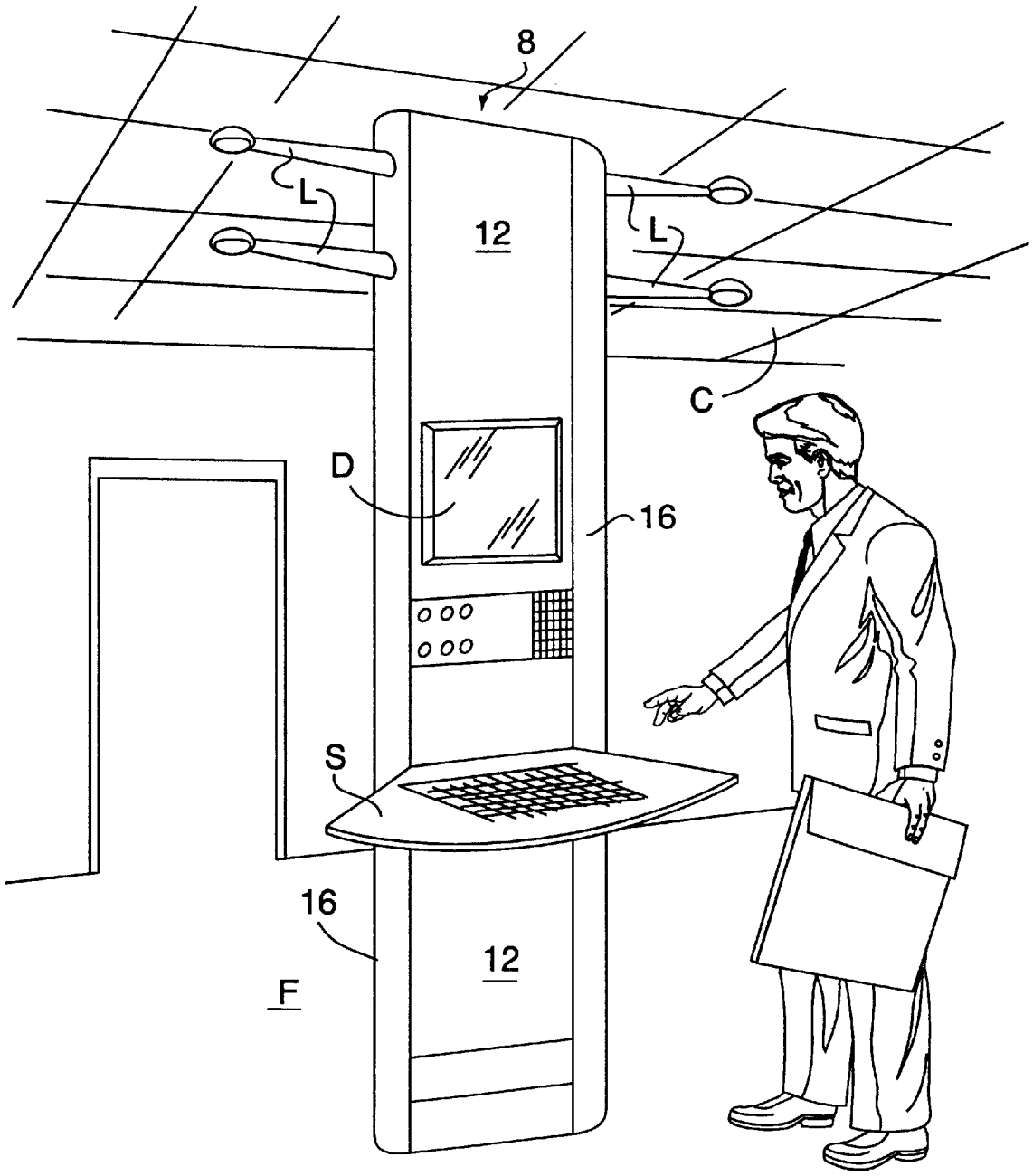
FIG. 1 is a perspective view showing a typical wall structure constructed in accordance with the present invention. The external appearance of the wall structure can be of different design than that shown, this view providing only one example from a wide variety of possibilities from plane paneled to including optional openings on one or both panel surfaces.

Turning now to the drawings in further detail, FIG. 1 shows a preferred embodiment of the invention wherein a wall structure generally referred to by the reference numeral 8, is secured to an existing floor structure, and may extend from the floor F to the ceiling C. The wall structure 8 may instead be self-supporting from the floor. The wall structure 8 includes cover panels 12 on front and rear sides thereof and raceway members 16 at opposing ends of the cover panels. FIG. 1 shows only one side of the wall structure 8. As shown in FIG. 1, the wall structure 8 is adapted to support light fixtures L, L mounted on the raceway members 16. Alternatively, lights can be supported from the cover panels 12 that comprise a front surface of the wall structure 8 and will be described in greater detail below. In further accordance with the present invention, the wall structure 8 may include suitable support means for supporting larger electrical components such as video monitors or displays D, as indicated generally in FIG. 1. While the cover panels 12 are sufficiently rugged to support light fixtures a shelf structure S may be incorporated to compliment the display D and be supported from studs within the structure to be described in greater detail hereafter.

Figure 2:
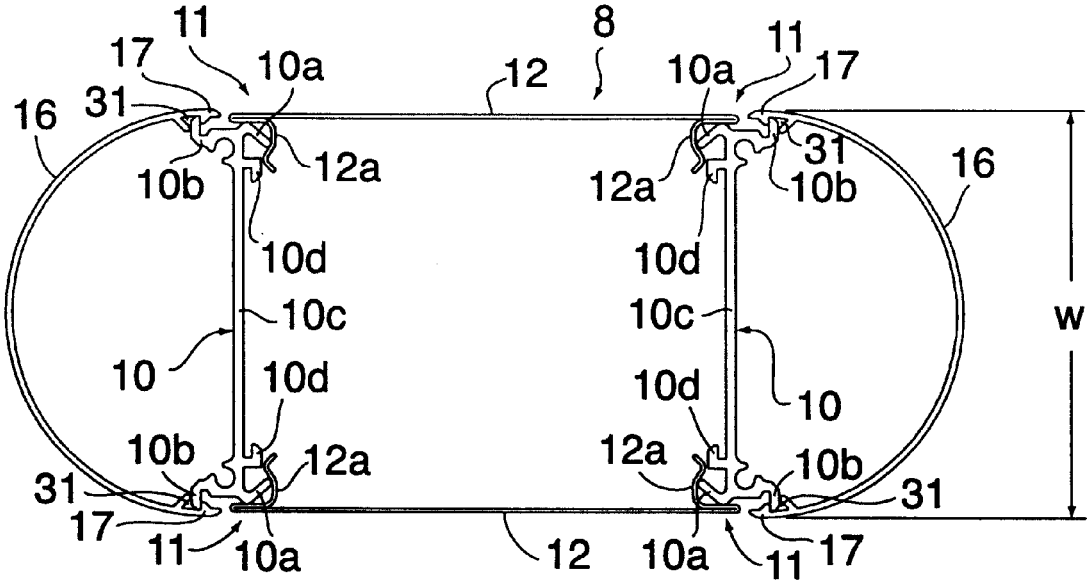
FIG. 2 is a horizontal sectional view taken through the wall structure of FIG. 1.

FIG. 2 shows the wall structure 8 in horizontal section as comprising at least two elongated vertically extending studs 10, 10. These studs are preferably arranged in pairs as shown in FIG. 2, and each stud 10 includes at least two sets of oppositely projecting inner flanges 10*a* and outer flanges 10*b* wherein the inner flanges 10*a* of each stud face one another and the outer flanges 10*b* of each stud face outwardly. These flanges 10*a* and 10*b* cooperate with the web portion 10*c* so that a generally I-shaped cross-sectional configuration is preferred for the stud 10. Other projections may be provided on the stud, which may be of extruded metal in order to facilitate forming of the stud flanges with the desired shape. Preferably, additional ribs, as shown in 10*d* for example, serve to anchor cross braces or the like, that are added for the purpose of additional strength.

Figure 3:
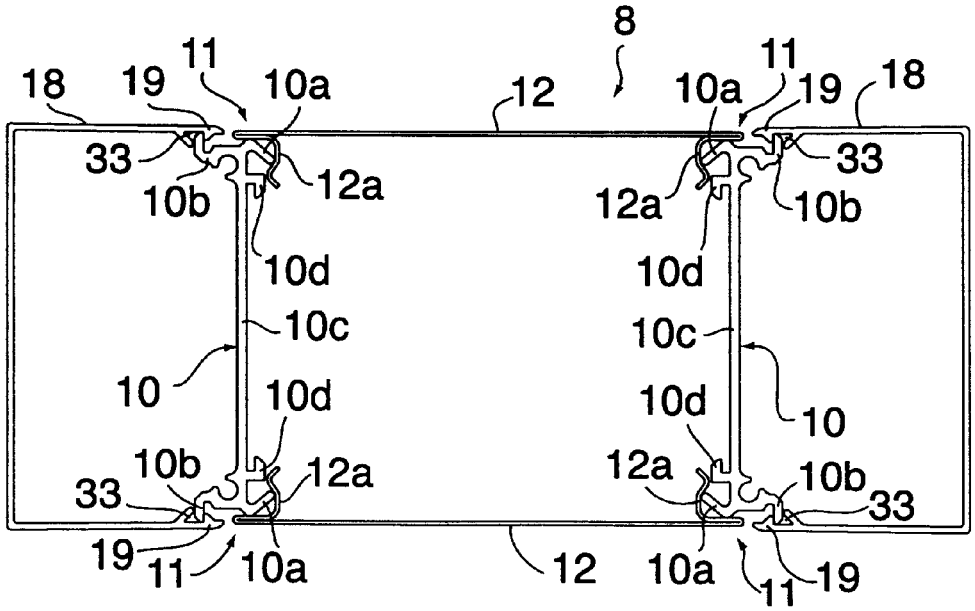
FIG. 3 is a sectional view taken through a slightly different wall structure configuration.
Figure 4:
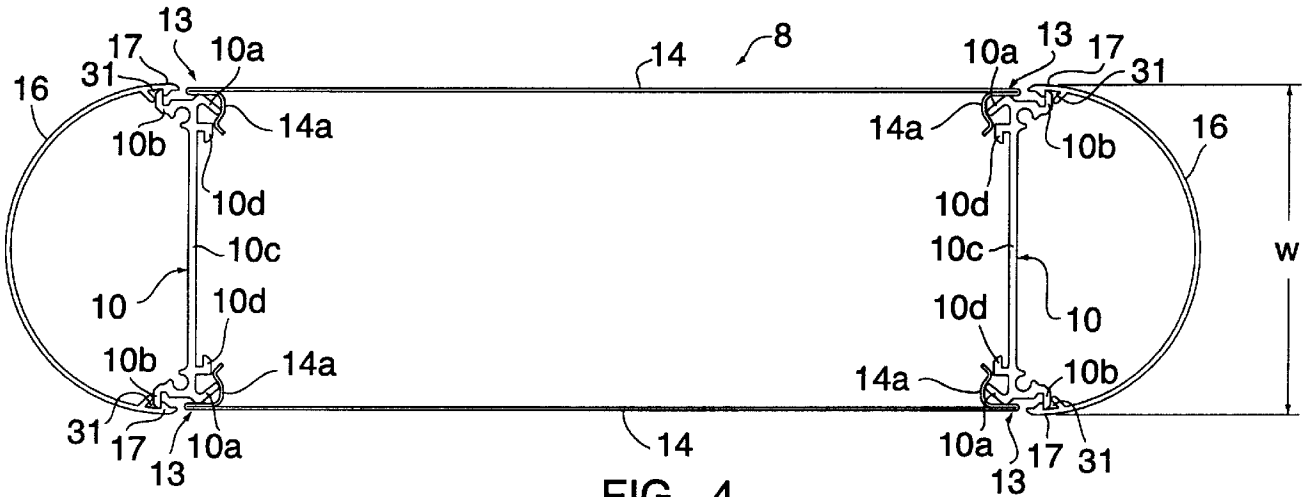
FIG. 4 is a view similar to FIG. 2 illustrating a still different wall structure.
Figure 5:
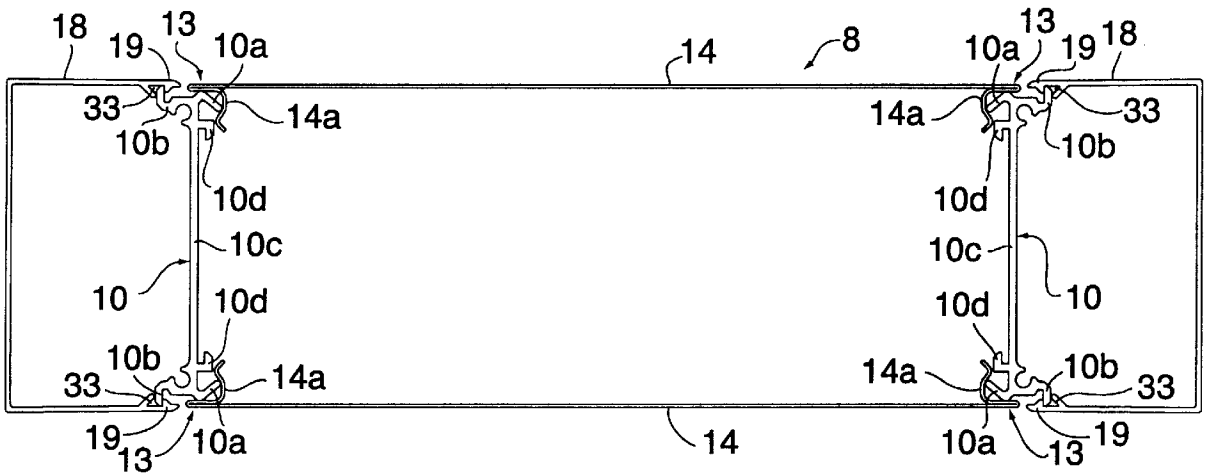
FIG. 5 is a view similar to FIG. 3 but showing still another wall structure in accordance with the present invention.

It will be apparent that the width w of the web $\mathbf{10}_c$ determines generally the width of the wall structure 8 itself, and as suggested in FIGS. 3, 4, and 5 variations are provided for, depending upon the needs of the architect who installs or calls for such a component in a building structure or office environment, so as to meet the needs of the space involved. Generally speaking, the width w will run between 3 and 5 inches so as to provide sufficient interior space to accommodate any elements which are required in the wall structure that can serve the functions outlined previously with reference to FIG. 1.

In further accordance with the preferred embodiment of the present invention cover panels 12 or 14 are provided as shown in FIGS. 2, 3, 4, and 5 to provide a wall structure of a predetermined length and shape, and which will fit the decor of the space which is to be fitted with a wall structure 8 of the present invention. Still, with reference to the panels 12 and 14 each such cover panel has marginal edge portions 11 and 13 respectively, defining in-turned lips $\mathbf{12}_a$ and $\mathbf{14}_a$ respectively, that cooperate with the first mentioned flanges $\mathbf{10}_a$ in order to provide a close fit, such that the flanges $\mathbf{10}_a$ support the panels 12 and 14 in much the same manner as a cover is supported on a raceway base in conventional two pieces surface steel raceway of the type sold by the Assignee herein (Wiremold) under Wiremold's 4000 series raceway. This identification of a preferred panel configuration is presented for illustration purposes only, and other panel configurations might be adapted for use with studs of different geometry provided only that flanges are formed on the marginal edges of the stud to receive correspondingly shaped lips on the marginal edges of the panels.

In further accordance with the presently preferred embodiment of the invention, raceway members 16 also of elongated configuration are provided with marginal edges 17 that mate with the outer flanges 10*b* on the aforementioned studs 10 and that are closed shape to define wireways in conjunction with the stud webs 10*c*, to receive power and data respectively.

FIGS. 2, 3, 4 and 5 illustrate different configurations of or cross-sectional shapes for these raceway members 16, FIG. 2 showing a half round cross-sectional configuration of a raceway member 16 that cooperates with the web 10*c* of the stud 10 to define a D shaped wireway. Other shapes can of course be provided including polygon shapes having several sides the cooperate to define a generally enclosed space for the wireways in conjunction with the web 10*c* of the studs 10. FIGS. 3 and 5 show rectangular raceway member cross-sectional configurations 18 having marginal edges 19. Other shapes can be provided with the scope of the present invention. All of these raceway member shapes have in common the provision that their marginal edges (17, 19) define elongated linear sockets (31, 33) for receiving the second set of flanges 10*b* on the studs 10 to anchor each of these raceway members to the stud in such a way that the external surface of the raceway member adjacent the marginal edges (17, 19) is tangent to the surface of the cover panels 12 or 14.

Figure 6:
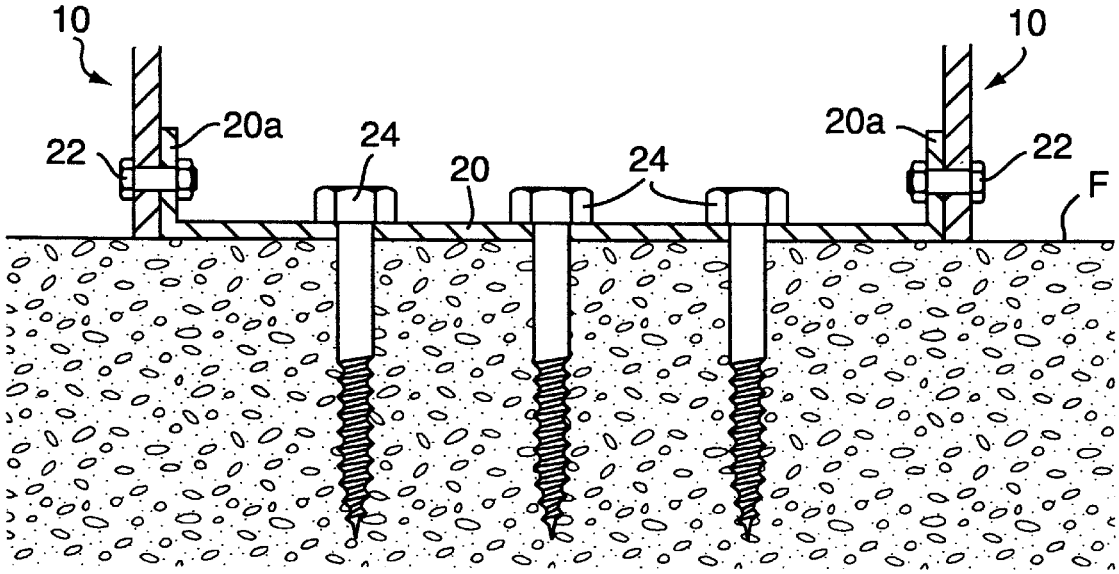
FIG. 6 is a view of the base of the wall structure illustrating the support for the wall structure from a floor.

As mentioned previously the studs 10, 10 are supported by cross braces similar to the form brace illustrated in FIG. 6. If a relatively heavy unit needs to be supported from the wall structure such cross braces might be employed to serve as a direct support for such units, or for shelves supporting such units. FIG. 6 shows a cross brace 20 having flanges $\mathbf{20}_a$ at its end portions that are adapted to be secure to web portions of the studs 10 by the fasteners 22, 22 in FIG. 6. In place of such fasteners 22 the cross brace 20 may include flanges $\mathbf{20}_a$ that are adapted to be received between ribs such as described previously with reference to $\mathbf{10}_d$ on the studs 10.

Figure 7:
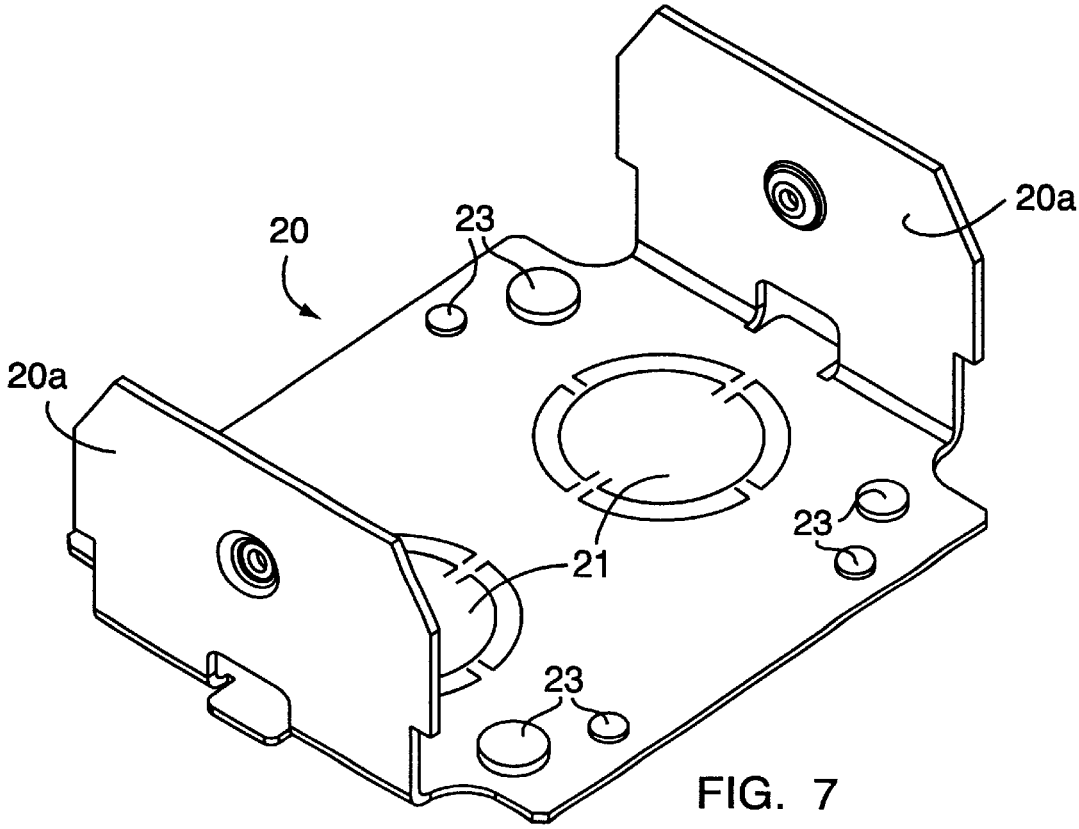
FIG. 7 is a top-side perspective view of a clip such as that shown in FIG. 6 of for use at vertically spaced locations between the studs.

As further shown in FIG. 6, the cross brace 20 is provided at the floor F of the space to be fitted with the wall structure in accordance with the present invention, and fasteners 24 are provided to secure the cross brace 20 to the floor F. FIG. 7 shows the cross brace 20 having knock-out openings 21 adaptable to receive wires or cables therethrough. The cross brace 20 also defines apertures 23 that are provided for attaching electrical components or shelves to the cross brace.

The wall structure of the present invention is connected to external electrical service and to appropriate data communication service lines directly from the floor F and/or directly into the wireways defined by the raceway members and stud webs, and/or through a ceiling structure or overhead feed for these service lines in the event that the wall structure extends from the floor to such ceiling. Thus, the wall structure of the present invention can serve as a power pole, or serve as a feed structure suitable for providing electrical service to an office coral or desktop. The wall structure is also capable of use by itself without such external structure and presents an architecturally striking vertical wall structure that provides a vertical solution to the architect who seeks to create a particular spacial environment. The wall structure can be fabricated from standard components, that nevertheless will present to the observer an architecturally pleasing unit.

We claim:

1. A wall structure comprising:

first and second separate vertically elongated studs, each stud having an I-shaped cross section defined by an integral web disposed between first and second sets of oppositely projecting flanges extending vertically along the vertical length of the stud, each set of flanges including an inner flange and an outer flange;

the first and second studs being positionable spaced apart one from the other in a direction generally perpendicular to the length of the studs and at a variable distance therebetween, the first and second studs being positionable so that the inner flanges of each stud face one another and the outer flanges of each stud face outwardly;

at least two cover panels of equal length selected from a plurality of cover panels of various predetermined lengths, the cover panels each having marginal edge portions which cooperate with the inner flanges of the first and second studs for coupling each of the cover panels to both of the first and second studs;

the first and second studs being positioned so that the spacing between the first and second studs corresponds to the length of the selected cover panels, the cover panels being coupled to the first and second studs and cooperating to form front and rear panels of the wall structure; and wherein an elongated raceway member coupled to the outer flanges of each of the first and second studs and cooperating with the web thereof to define a wireway.

2. The wall structure of claim 1 wherein the raceway members have a cross-sectional shape that is semi-circular, the cover panels being arranged generally tangentially to the semi-circular shaped raceway members.

3. The wall structure of claim 1 wherein said raceway members include marginal edges defining elongated linear sockets for receiving said outer flanges of said studs in a snap fit arrangement that relies on the inherent flexibility and resiliency of the material from which the raceway members are fabricated.

4. The wall structure according to claim 1 wherein the marginal edge portions of the cover panels are resiliently flexible so as to provide a snap fit with said inner flanges of the first and second studs.

5. The wall structure of claim 1 further comprising at least one cross brace disposed between the first and second studs and coupled thereto securing the first and second studs to one another.

6. The wall structure of claim 5 wherein the first and second studs further comprise at least one rib for securing the at least one cross brace thereto.

7. The wall structure of claim 5 further comprising an electrical component coupled to one of the first or second studs, the cross brace, the raceway member, and the cover panels.

* * * * *